US011113910B2

(12) United States Patent
Chen

(10) Patent No.: US 11,113,910 B2
(45) Date of Patent: Sep. 7, 2021

(54) ANTI-PASSBACK METHOD, APPARATUS AND SYSTEM

(71) Applicant: HANGZHOU HIKVISION DIGITAL TECHNOLOGY CO., LTD., Hangzhou (CN)

(72) Inventor: Wei Chen, Hangzhou (CN)

(73) Assignee: HANGZHOU HIKVISION DIGITAL TECHNOLOGY, Hangzhou (CN)

( * ) Notice: Subject to any disclaimer, the term of this patent is extended or adjusted under 35 U.S.C. 154(b) by 241 days.

(21) Appl. No.: 16/305,154

(22) PCT Filed: Nov. 2, 2016

(86) PCT No.: PCT/CN2016/104359
§ 371 (c)(1),
(2) Date: Nov. 28, 2018

(87) PCT Pub. No.: WO2017/215180
PCT Pub. Date: Dec. 21, 2017

(65) Prior Publication Data

US 2020/0320812 A1 Oct. 8, 2020

(30) Foreign Application Priority Data

Jun. 14, 2016 (CN) ..... 201610415695.9

(51) Int. Cl.
*G07C 9/15* (2020.01)
*G07C 9/27* (2020.01)
*G07C 9/00* (2020.01)

(52) U.S. Cl.
CPC ..... *G07C 9/15* (2020.01); *G07C 9/00309* (2013.01); *G07C 9/27* (2020.01); *G07C 2209/08* (2013.01)

(58) Field of Classification Search
CPC ..... G07C 9/15; G07C 9/00309; G07C 9/27; G07C 2209/08
(Continued)

(56) References Cited

U.S. PATENT DOCUMENTS

2009/0050697 A1* 2/2009 Sparks ..... G07C 9/257 235/382.5
2010/0077474 A1* 3/2010 Yacoub ..... G07C 9/27 726/20
(Continued)

FOREIGN PATENT DOCUMENTS

CN 101192316 6/2008
CN 202268049 U 6/2012
(Continued)

OTHER PUBLICATIONS

European Search Report of EP Application No. 16905292.5.

*Primary Examiner* — Hirdepal Singh
(74) *Attorney, Agent, or Firm* — Blank Rome LLP

(57) ABSTRACT

Embodiments of the present application disclose an anti-passback method, apparatus and system. A plurality of access controllers are communicatively connected to a server. After detecting that a card reader has successfully read an identifier of an access card, an access controller sends the identifier of the access card, an identifier of the card reader, and its own identifier to the server. The server searches for the identifier of the card reader that read the access card last time, and the identifier of the access controller corresponding to the card reader, and determines a route for the door opening request. When the determined route exists in a preset list of routes, the sever sends a door opening instruction to the access controller. The route list may include routes between doors under the control of the plurality of access controllers. When a user swipes on a card reader on any of the doors with an access card, the access
(Continued)

controller that controls the card reader will transmit information to the server. The server determines whether to allow the passing based on the route list. As can be seen, such solution achieves the anti-passback feature among a plurality of access controllers.

11 Claims, 3 Drawing Sheets

(58) Field of Classification Search
USPC ..... 340/5.61
See application file for complete search history.

(56) References Cited

U.S. PATENT DOCUMENTS

| | | | | |
|---|---|---|---|---|
| 2012/0032775 | A1 | 2/2012 | Kikuchi | |
| 2013/0093563 | A1* | 4/2013 | Adolfsson | G07C 9/32 340/5.7 |
| 2016/0092666 | A1* | 3/2016 | Padilla | G06F 21/6245 726/27 |
| 2016/0171231 | A1* | 6/2016 | Evans | G08B 25/14 726/17 |
| 2017/0048246 | A1* | 2/2017 | Gopalakrishna | H04L 63/10 |
| 2017/0270722 | A1* | 9/2017 | Tse | G07C 9/30 |
| 2019/0258782 | A1* | 8/2019 | Lerner | H04L 63/0272 |

FOREIGN PATENT DOCUMENTS

| | | | |
|---|---|---|---|
| CN | 202584248 | | 12/2012 |
| CN | 103440687 | A | 12/2013 |
| CN | 105187771 | A | 12/2015 |
| CN | 105405181 | A | 3/2016 |
| CN | 105447927 | A | 3/2016 |
| GB | 2 446 912 | A | 8/2008 |
| JP | 4 634198 | B2 | 2/2011 |
| JP | 2013171572 | A | 9/2013 |
| WO | WO 2016/086315 | A1 | 6/2016 |

* cited by examiner

ANTI-PASSBACK METHOD, APPARATUS AND SYSTEM

This application is a U.S. national stage application based on International Application No. PCT/CN2016/104359 filed Nov. 2, 2016, which claims priority to Chinese Patent Application No. 201610415695.9, filed Jun. 14, 2016, both of which are herein incorporated by reference in their entirety.

TECHNICAL FIELD

The present application relates to the field of security, and in particular to an anti-passback method, apparatus and system.

BACKGROUND

Anti-passback is one of the functions provided by an access control system. Anti-passback, for example, includes access anti-passback and route anti-passback. The access anti-passback requires that a card holder must swipe out from the door where he or she swiped in. The record of swiping in must exactly match with the record of swiping out. The route anti-passback requires that if a card holder swiped in from a door, he or she must swipe out, according to a preset route, from a door corresponding to the route.

Existing anti-passback techniques are generally implemented by access controllers. An access controller may be configured with a list of routers between several doors under the control of the access controller. The list may include a route list for access anti-passback or a route list for route anti-passback. After receiving a request for entry, the access controller determines whether to open the door corresponding to the entry request according to the identifier of the access card and the list of routes.

However, since the access controller can control only a few doors, and the route list configured in the access controller only includes routes between a few doors. Thus, such an approach can only achieve anti-passback for a few doors under the control of the access controller.

If there are a plurality of access controllers in a large office building, it is impossible for the above approach to achieve anti-passback function in the entire office building.

SUMMARY

The objectives of the embodiments of the present application are to provide an anti-passback method, apparatus and system to enabling an anti-passback function in case of a plurality of access controllers.

In order to achieve the above objectives, an embodiment of the present application discloses an anti-passback method, applicable to a server communicatively connected to at least two access controllers. The method includes:

receiving a door opening request sent by a first access controller, wherein the door opening request contains an identifier of an access card, an identifier of the first access controller, and an identifier of a first card reader reading the access card this time, the first card reader being attached to a door controlled by the first access controller;

searching, based on the identifier of the access card, for an identifier of a second card reader that read the access card last time, and an identifier of a second access controller corresponding to the second card reader;

determining a route for the door opening request according to the identifier of the first card reader, the identifier of the first access controller, the identifier of the second card reader, and the identifier of the second access controller;

determining whether the determined route exists in a preset list of routes; and if so, sending a door opening instruction to the first access controller to allow the first access controller to open a door corresponding to the door opening request according to the door opening instruction.

Optionally, after sending the door opening instruction to the first access controller, the method can further include:

updating the identifier of the card reader that read the access card last time from the identifier of the second card reader to the identifier of the first card reader, and updating the identifier of the access controller corresponding to the card reader that read the access card last time from the identifier of the second access controller to the identifier of the first access controller.

Optionally, a first valid period for correspondence among an identifier of an access card, an identifier of a card reader and an identifier of an access controller is set in the server, and after receiving the door opening request sent by the first access controller, the method further includes:

determining, according to the first valid period, whether a correspondence among the identifier of the access card, the identifier of the first card reader, and the identifier of the first access controller is valid at the moment;

if so, performing the step of: searching, based on the identifier of the access card, for an identifier of a second card reader that read the access card last time, and an identifier of a second access controller corresponding to the second card reader.

Optionally, the method can further include:

sending a door opening instruction to the first access controller directly in the case that the identifier of the second card reader and the identifier of the second access controller are not found.

Optionally, an identifier of an initial card reader and a second valid period for correspondence between an identifier of an access card and the identifier of the initial card reader are set in the server, and after receiving the door opening request sent by the first access controller, the method further includes:

determining whether the first card reader is the initial card reader;

if the first card reader is not the initial card reader, performing the step of: searching, based on the identifier of the access card, for an identifier of a second card reader that read the access card last time, and an identifier of a second access controller corresponding to the second card reader; and if the first card reader is the initial card reader, determining, according to the second valid period, whether the correspondence between the identifier of the access card and the identifier of the initial card reader is valid at the moment; and if the correspondence is valid, sending a door opening instruction to an access controller corresponding to the initial card reader.

In order to achieve the above objectives, an embodiment of the present application further discloses an anti-passback method, applicable to a first controller communicatively connected to a server. The method can include:

detecting whether a first card reader attached to a door controlled by the first access controller successfully reads an identifier of an access card;

if so, sending a door opening request to the server, wherein the door opening request contains an identifier of the access card, an identifier of the first card reader, and an identifier of the first access controller;

receiving a door opening instruction sent by the server, wherein the door opening instruction is sent by the server when a route determined according to an identifier of a second card reader, an identifier of a second access controller, the identifier of the first card reader, and the identifier of the first access controller exists in a preset list of routes; the identifier of the second card reader is an identifier of a card reader that reads the access card last time, which is found according to the identifier of the access card; and the second card reader is a card reader attached to a door controlled by the second access controller; and controlling a door corresponding to the door opening request to open.

Optionally, after detecting that the first card reader successfully reads the identifier of the access card, the method can further include:

determining whether an anti-passback function is enabled; and if so, performing the step of sending a door opening request to the server.

In order to achieve the above objectives, an embodiment of the present application further discloses an anti-passback apparatus, applicable to a server communicatively connected to at least two access controllers. The apparatus includes:

a first receiving module, configured for receiving a door opening request sent by a first access controller, wherein the door opening request contains an identifier of an access card, an identifier of the first access controller, and an identifier of a first card reader reading the access card this time, the first card reader being attached to a door controlled by the first access controller;

a searching module, configured for searching, based on the identifier of the access card, for an identifier of a second card reader that read the access card last time, and an identifier of a second access controller corresponding to the second card reader;

a first determining module, configured for determining a route for the door opening request according to the identifier of the first card reader, the identifier of the first access controller, the identifier of the second card reader, and the identifier of the second access controller;

a first judging module, configured for determining whether the determined route exists in a preset list of routes; and a first sending module, configured for sending, when the judging module determines that the determined route exists in the preset list of routes, a door opening instruction to the first access controller to allow the first access controller to open a door corresponding to the door opening request according to the door opening instruction.

Optionally, the apparatus can further include:

an update module, configured for updating the identifier of the card reader that read the access card last time from the identifier of the second card reader to the identifier of the first card reader, and updating the identifier of the access controller corresponding to the card reader that read the access card last time from the identifier of the second access controller to the identifier of the first access controller.

Optionally, a first valid period for correspondence among an identifier of an access card, an identifier of a card reader and an identifier of an access controller is set in the server, and the apparatus further includes:

a second judgment module, configured for determining, according to the first valid period, whether a correspondence among the identifier of the access card, the identifier of the first card reader, and the identifier of the first access controller is valid at the moment, and if so, triggering the searching module.

Optionally, the apparatus can further include:

a second sending module, configured for sending a door opening instruction to the first access controller directly in the case that the searching module does not find the identifier of the second card reader and the identifier of the second access controller.

Optionally, an identifier of an initial card reader and a second valid period for correspondence between an identifier of an access card and the identifier of the initial card reader are set in the server, and the apparatus further includes:

a third judgment module, configured for determining whether the first card reader is the initial card reader, and if not, triggering the searching module;

a fourth judgment module, configured for determining, according to the second valid period, whether the correspondence between the identifier of the access card and the identifier of the initial card reader is valid at the moment, when the third judgment module determines that the first card reader is the initial card reader;

a third sending module, configured for sending a door opening instruction to an access controller corresponding to the initial card reader, when the fourth determining module determines that the correspondence between the identifier of the access card and the identifier of the initial card reader is valid at the moment.

In order to achieve the above objectives, an embodiment of the present application further discloses an anti-passback apparatus, applicable to a first controller communicatively connected to a server. The apparatus can include:

a detecting module, configured for detecting whether a first card reader attached to a door controlled by the first access controller successfully reads an identifier of an access card, and if so, triggering a fourth sending module;

a fourth sending module, configured for sending a door opening request to the server, wherein the door opening request contains an identifier of the access card, an identifier of the first card reader, and an identifier of the first access controller;

a second receiving module, configured for receiving a door opening instruction sent by the server, wherein the door opening instruction is sent by the server when a route determined according to an identifier of a second card reader, an identifier of a second access controller corresponding to the identifier of the second card reader, the identifier of the first card reader, and the identifier of the first access controller exists in a preset list of routes; the identifier of the second card reader is an identifier of a card reader that last read the access card, which is found according to the identifier of the access card; and the second card reader is a card reader attached to a door controlled by the second access controller; and a control module, configured for controlling a door corresponding to the door opening request to open.

Optionally, the apparatus can further include:

a fifth judgment module, configured for determining whether an anti-passback function is enabled, and if so, triggering the fourth sending module.

In order to achieve the above objectives, an embodiment of the present application further discloses an anti-passback system, including a server, at least two access controllers, and a card reader.

The card reader is configured for reading an identifier of an access card, and uploading the identifier of the access card and its own identifier to an access controller.

The access controllers are configured for: detecting whether a first card reader attached to a door controlled by a first access controller successfully reads an identifier of an access card; if so, sending a door opening request to the server, wherein the door opening request contains the identifier of the access card, an identifier of the first card reader, and an identifier of the first access controller; receiving a door opening instruction sent by the server, wherein the door opening instruction is sent by the server when a route determined according to an identifier of a second card reader, an identifier of a second access controller, the identifier of the first card reader, and the identifier of the first access controller exists in a preset list of routes; the identifier of the second card reader is an identifier of a card reader that read the access card last time, which is found according to the identifier of the access card; and the second card reader is a card reader attached to a door controlled by the second access controller; and controlling a door corresponding to the door opening request to open;

The server is configured for: receiving a door opening request sent by a first access controller, wherein the door opening request contains an identifier of an access card, the identifier of the first access controller, and an identifier of a first card reader reading the access card this time, the first card reader being attached to a door controlled by the first access controller; searching, based on the identifier of the access card, for an identifier of a second card reader that read the access card last time, and an identifier of a second access controller corresponding to the second card reader; determining a route for the door opening request according to the identifier of the first card reader, the identifier of the first access controller, the identifier of the second card reader, and the identifier of the second access controller; determining whether the determined route exists in a preset list of routes; and if so, sending a door opening instruction to the first access controller to allow the first access controller to open a door corresponding to the door opening request according to the door opening instruction.

In order to achieve the above objectives, an embodiment of the present application further discloses a server, including a housing, a processor, a memory, a circuit board and a power supply circuit, wherein the circuit board is arranged inside a space enclosed by the housing, the processor and the memory are arranged on the circuit board; the power supply circuit is used to supply power for various circuits or components of the server; the memory is used to store an executable program code; and the processor is configured for executing a program corresponding to the executable program code by reading the executable program code stored in the memory to perform the above anti-passback method applicable to a server.

In order to achieve the above objectives, an embodiment of the present application further discloses an executable program code. The executable program code is executed to perform the anti-passback method applicable to the server as described above.

In order to achieve the above objectives, an embodiment of the present application further discloses a storage medium. The storage medium is configured for storing an executable code which, when being executed, perform the anti-passback method applicable to a server as described above.

In order to achieve the above objectives, an embodiment of the present application further discloses an access controller, including a housing, a processor, a memory, a circuit board and a power supply circuit. The circuit board is arranged inside a space enclosed by the housing. The processor and the memory are arranged on the circuit board. The power supply circuit is used to supply power for various circuits or components of the access controller. The memory is used to store an executable program code. The processor is configured for executing a program corresponding to the executable program code by reading the executable program code stored in the memory to perform the above anti-passback method applicable to an access controller.

In order to achieve the above objectives, an embodiment of the present application further discloses an executable program code. The executable program code is configured for performing, when being executed, the anti-passback method applicable to an access controller as described above.

In order to achieve the above objective, an embodiment of the present application further discloses a storage medium. The storage medium is configured for storing an executable code which, when being executed, perform the anti-passback method applicable to an access controller as described above.

In the embodiments of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for the identifier of a second card reader that read the access card last time, and the identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset route list, and if so, sends the door opening instruction to the first access controller, such that the first access controller controls a door corresponding to the door opening request to open according to the door opening instruction. The preset route list may include routes between doors under control of the plurality of access controllers communicatively connected to the server. When a user presents an access card to a card reader on any of the doors, the access controller that controls the door where the card reader is located will transmit information to the server. The server determines whether to allow passing based on the preset route list. As can be seen, such a solution achieves an anti-passback feature in the case of a plurality of access controllers.

BRIEF DESCRIPTION OF THE DRAWINGS

In order to more clearly describe the technical solution of the embodiments of the application and the prior art, drawings needed in the embodiments and the prior art will be briefly described below. Obviously, the drawings described below are for only some embodiments of the present application, one of ordinary skills in the art can also obtain other drawings based on these drawings without any creative efforts.

DETAILED DESCRIPTION

The present application will be described in detail with reference to the accompanying drawings and embodiments, so that the objectives, technical solutions, and advantages of the present application can be better understood. Obviously, the embodiments described are only some of the embodiments of the present application instead of all the embodiments. All other embodiments obtained by those of ordinary skills in the art based on the embodiments herein without any creative efforts are within the scope of the present application.

Figure 5:
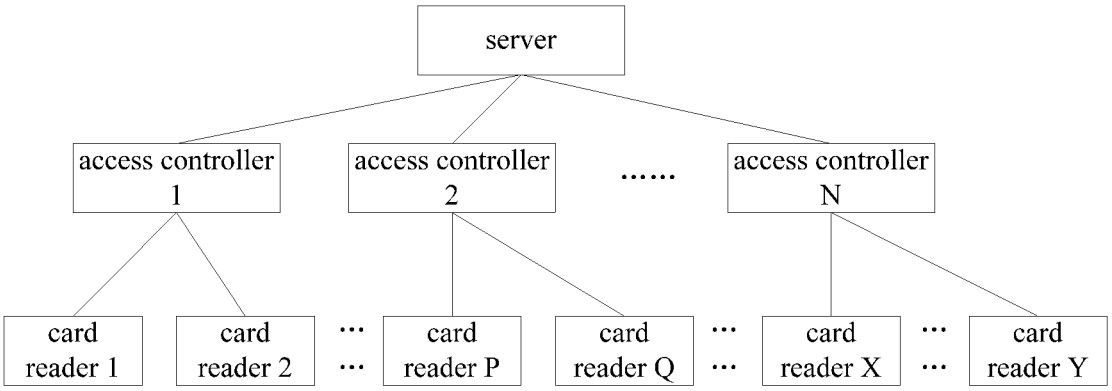
FIG. 5 is a schematic structural diagram of an anti-passback system provided by an embodiment of the present application.

In order to solve the technical problem above, embodiments of the present application provide an anti-passback method, apparatus and system. The anti-passback system can include a server, at least two access controllers (access controller 1, access controller 2, . . . , and access controller N), and card readers (card reader 1, card reader 2, . . . , card reader P, card reader Q, . . . , card reader X, and card reader Y), as shown in FIG. 5. The server is in communication with the access controllers, and the card readers are placed on doors controlled by the access controllers.

Figure 1:
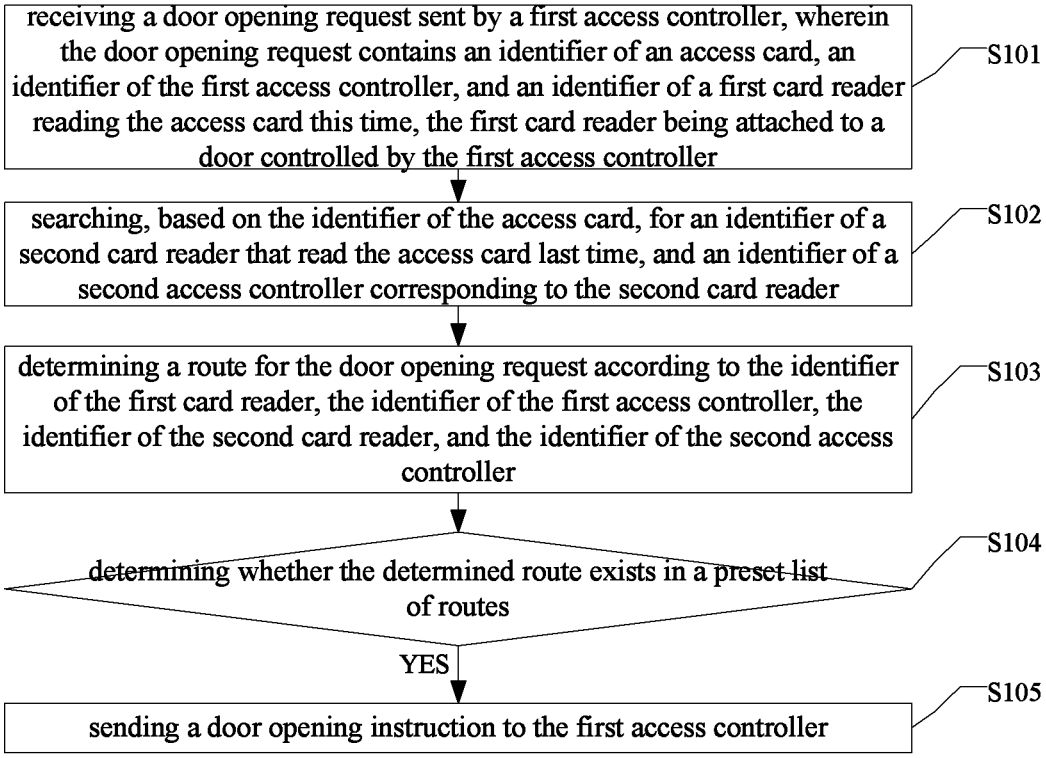
FIG. 1 is a flow chart of an anti-passback method applied to a server provided by an embodiment of the present application.

The anti-passback method applicable to the server in the anti-passback system is now described in detail in conjunction with the embodiments of the present application. As shown in FIG. 1, the method includes:

S101, receiving a door opening request sent by a first access controller, wherein the door opening request contains an identifier of an access card, an identifier of the first access controller, and an identifier of a first card reader reading the access card this time, the first card reader being attached to a door controlled by the first access controller.

The first access controller may be any access controller in communication with (i.e., under the management of) the server.

In the embodiment illustrated herein, a server can be communicatively connected to a plurality of access controllers. An access controller can control a plurality of doors. On each of the doors, two readers can be attached, which are used to read the information about that the user swipes in and out, respectively.

In an implementation of the present application, in order to ensure the reliability of communication between the server and the access controllers, the communication between the server and the access controllers can be transmitted based on TCP (Transmission Control Protocol).

Each access controller has its own identifier to be distinguished from other access controllers connected to the same server. Similarly, each reader has its own identifier to be distinguished from other readers controlled by the same access controller.

In the embodiment illustrated herein, it is assumed that the server can be communicatively connected to 16 access controllers, each access controller controls 4 doors, and each door is provided with two card readers. That is, each access controller controls 8 card readers, the identifiers of which may be 1-8.

The server is preconfigured with anti-passback information as follows.

First, the server may be configured to enable anti-passback function. It can be understood that the anti-passback function can be enabled or disabled depending on actual needs.

The identifiers of the 16 access controllers connected to the server are recorded. In an implementation of the present application, correspondences between production serial numbers and identifiers of the 16 access controllers may be stored in the server. The server determines the identifier of an access controller based on the production serial number thereof. Specifically, the identifiers of the access controllers may be 1-16.

The identifiers of 128 access controllers on 64 doors controlled by the 16 access controllers are recorded. The identifiers of the card readers are stored in association with the identifiers of the access controllers. The identifier of a card reader may be stored in the form of 06-07, representing a card reader identified as 07 controlled by an access controller identified as 06. It should be noted that if an access controller or a card reader does not support the anti-passback function, the identifier of the access controller or the card reader may not be stored in the server.

A route list is set. The route list is a list of routes for the 128 card readers under control of the 16 access controllers, and may include an access anti-passback list and a route anti-passback list. Card readers at both ends of a route contained in the anti-passback list are card readers on the same door. Taking the route of 01-05—01-06 as an example, 01-05 and 01-06 represent two readers identified as 05 and 06 and located on the same door controlled by the access controller identified as 01. The route 01-05—01-06 indicates the route entering and exiting by this door. The access anti-passback list is simple and will not be described here in detail. The route anti-passback list is set depending on specific situations. For example, a user entering from the door A may exit from three doors B, E, or K. When the user enters from the door A, the card reader 01-01 reads the identifier of an access card of the user. When the user exits from the door B, the card reader 01-04 reads the identifier of the access card of the user. When the user exits from the door E, the card reader 02-02 reads the identifier of the access card of the user. When the user exits from the door K, the card reader 03-06 reads the identifier of the access card of the user. That is, the following three routes can be included in the route list: 01-01—01-04, 01-01—02-02, and 01-01—03-06.

In the embodiment illustrated herein, assume that the user swipes on the card reader 02 on the door A with an access card. If the access card is invalid, the access controller 01 controlling the door A would detect that the card reader 02 fails to read the identifier of the access card. Thus, the access controller 01 does not process, and door A will not open. If the access card is valid and have an identifier Z, the card reader 02 successfully reads the identifier of the access card as Z. Upon the detection that the card reader 02 has successfully read the card identifier, the access controller 01 sends a door opening request to the server connected to it. The door opening request contains the identifier Z of the access card, the identifier 02 of the first card reader that reads the access card, and the identifier 01 of the first access controller. The first card reader 02 is a card reader on the door controlled by the first access controller 01.

S102, searching, based on the identifier of the access card, for an identifier of a second card reader that read the access card last time, and an identifier of a second access controller corresponding to the second card reader.

In an embodiment of the present application, for each valid access card, the server records the identifier of the card reader that read the access card last time and the identifier of the access controller corresponding to the card reader within a preset duration. The preset duration can be set depending on actual needs, such as 24 hours, 12 hours, etc., which is not limited herein.

The server searches, according to the identifier Z of the access card, for the identifier of the second card reader that read the access card Z last time, and the identifier of the second access controller corresponding to the identifier of the second card reader. For example, it is found that the identifier of the second card reader is 05 and the identifier of the second access controller is 03.

S103, determining a route for the door opening request according to the identifier of the first card reader, the identifier of the first access controller, the identifier of the second card reader, and the identifier of the second access controller.

The identifier of the first card reader is 02, the identifier of the first access controller is 01, the identifier of the second card reader is 05, and the identifier of the second access controller is 03. Thus, the route for the door opening request is 03-05—01-02.

S104, determining whether the determined route exists in a preset list of routes, and if so, proceeding to S105.

The preset list of routes in the server is set depending on the anti-passback routes. Only the routes that exist in the route list are valid and allowed for passing. If the determined route does not exist in the route list, the server will not process further, and the door that is requested to open will not open.

S105, sending a door opening instruction to the first access controller to allow the first access controller to open a door corresponding to the door opening request according to the door opening instruction.

If the determined route exists in the route list, the route is valid and is allowed for passing. The server then sends the door opening instruction to the first access controller. After receiving the door opening instruction, the first access controller controls a door corresponding to the door opening request to open.

In the embodiment shown in FIG. 1 of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes on a card reader on any of the doors with an access card, the access controller that controls the door where the card reader is located will transmit information to the server. The server determines whether to allow the passing based on the preset list of routes. As can be seen, such a solution achieves an anti-passback feature in the case of a plurality of access controllers.

As explained above, for each valid access card, the server records the identifier of the card reader that read the access card last time and the identifier of the access controller corresponding to the card reader within a preset duration. Therefore, after the sever sends the door opening instruction to the first access controller, for the access card Z, the server updates the recorded identifier of the card reader that last read access card Z with the identifier 02 of the first card reader, and updates the recorded identifier of the second access controller corresponding to the second card reader with the identifier 01 of the first access controller.

That is, whenever the server sends a door opening instruction to the access controller, the server updates the identifier of the card reader that last read the access card corresponding to the door opening instruction and the identifier of the access controller corresponding to the card reader, which the server records, to ensure the accuracy of the recorded information.

In the embodiment illustrated herein, a first valid period for correspondence among an identifier of an access card, an identifier of a card reader and an identifier of an access controller may be set in the server. It can be understood that a user's authority to gain access to a region can be time-limited. For example, general employees can only have access to the company on working days, and the company supervisors can have access to the company on non-working days. Therefore, in the server, the first valid period for the correspondence among the identifier of the access card of general employees and the identifier of the card reader on the company's door and the identifier of the access controller corresponding to the card reader can be set as working days. The first valid period for the correspondence among the identifier of the access card of company supervisors and the identifier of the card reader on the company's door and the identifier of the access controller corresponding to the card reader can be set as working days and non-working days.

Upon receiving a door opening request sent by the access controller, the server may determine, according to the set valid period, whether the correspondence among the identifier of the access card, the identifier of the first card reader, and the identifier of the first access controller contained in the door opening request is valid at the current moment. If the correspondence is invalid, the server will not process further, and the door requested to open will not open. If it is valid, S102 and subsequent steps will be performed.

For example, it is assumed an employee M is only allowed to access the company on working days, and the door of the company where the employee M works is door A. The employee M swipes his access card on a card reader 01 on the door A on a non-working day. The card has an identifier Z, and the card reader 01 successfully reads the identifier Z of the access card. The access controller 01 detects that the card reader 01 has successfully read the identifier of the card, and sends a door opening request to its connected server. The door opening request contains the identifier Z of the access card, the identifier 01 of the first card reader that reads the access card, and the identifier 01 of the first access controller. The first card reader 01 is a card reader attached to a door controlled by the first access controller 01.

The first valid period for the correspondence among the identifier Z of the access card, the identifier 01 of the card reader, and the identifier 01 of the access controller is set as working days in the server. After receiving the door opening request, the server determines, according to the first valid period, that the current moment is a non-working day, namely the correspondence among the identifier Z of the access card, the identifier 01 of the card reader, and the identifier 01 of the access controller is invalid at the moment. The server thus does not respond, and the door A will not open.

Conversely, if the current moment is a working day, the server determines that the correspondence among the identifier Z of the access card, the identifier 01 of the card reader, and the identifier 01 of the access controller is valid at the moment. The server will then search for the identifier of the second card reader that read the access card last time, and the identifier of the second access controller corresponding to the second card reader, based on the identifier Z of the access card. The rest of the processes is the same as the solution above, and will not be repeated herein.

In the embodiment illustrated herein, a case may occur that the server does not find the identifier of the second card reader that read the access card last time, and the identifier of the second access controller corresponding to the second card reader, based on the identifier of the access card. That is, no card reader has read the identifier of the access card within the preset duration recorded on the server. For a preset duration of 24 hours, this indicates that it is the first time within 24 hours that the user having the access card enters the area managed by the server, or it is the first time within 24 hours that the user swipe the access card on the card reader supporting the anti-passback feature in the area managed by the sever. In both cases, the server directly sends a door opening instruction to the first access controller without determining a route for the door opening request.

In an area where the anti-passback function is provided, it often occurs that a user forgets the preset route and cannot reach the destination. Thus, in the embodiment illustrated herein, an initial card reader can be set. When a user forgets the set route, he/she may find the initial card reader to start the anti-passback route again. The initial reader can be placed in a conspicuous place, making it easier for users who forget the route to find the initial reader.

If an initial reader is set, the identity of the initial reader can be marked in the server. In the case where the initial card reader is set, after receiving the door opening request sent by the access controller, it is first determined whether the identifier of the card reader contained in the door opening request is the identifier of the initial card reader. If so, a door opening instruction may be directly sent to the access controller corresponding to the initial card reader.

Of course, in combination with the solution above, a second valid period for the correspondence between the identifier of the access card and the identifier of the initial card reader may also be set in the server. If it is determined that the identifier of the card reader contained in the door opening request is the same as the identifier of the initial card reader, it may be further determined whether the correspondence between the identifier of the access card contained in the door opening request and the identifier of the initial card reader is valid at the moment. If it is valid, the door opening instruction is sent to the access controller corresponding to the initial card reader. If it is invalid, no process is performed.

As an example, the initial card reader can be placed on the door of the office building. If the user is not allowed to enter the office building during non-working days, the door of the office building will not open when the user swipes the access card on the initial card reader.

If the server determines, upon the receipt of a door opening request, that the identifier of the card reader contained in the door opening request is different from the identifier of the initial card reader, the server may operate according to the flow of the above solution, details of which will not described herein again.

Figure 2:
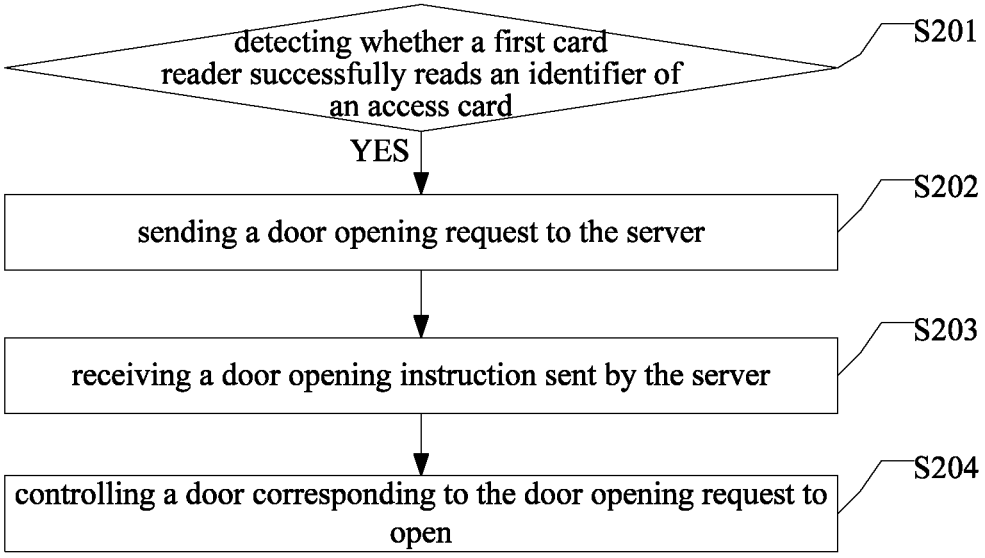
FIG. 2 is a flow chart of an anti-passback method applied to a first access controller provided by an embodiment of the present application.

FIG. 2 is a flow chart of an anti-passback method provided by an embodiment of the present application, applicable to a first access controller. The method includes:

S201, detecting whether a first card reader attached to a door controlled by the first access controller successfully reads an identifier of an access card, and if so, performing S202.

In the embodiment illustrated herein, in order to ensure that the access controller is communicatively connected to the server, the address or port information of the server may be pre-configured in the access controller. An access controller can control a plurality of doors. Each door can be provided with two card readers, which are used to read the information about that the user swipes in and out, respectively.

Each access controller has its own identifier to be distinguished from other access controllers connected to the same server. Similarly, each reader has its own identifier to be distinguished from other readers controlled by the same access controller.

In the embodiment illustrated herein, it is assumed that each access controller controls 4 doors, and each door is provided with two card readers. That is, each access controller controls 8 card readers, the identifiers of which may be 1-8.

The user, for example, swipes the card reader 02 on the door A with an access card. If the access card is an invalid card, the access controller 01 controlling the door A detects that the card reader 02 fails to read the identifier of the access card. Thus, the access controller 01 will not respond, and the door A thereby will not open. If the access card is a valid card having an identifier Z, the card reader 02 successfully reads the identifier of the access card as Z, and the access controller 01 detects that the card reader 02 has successfully read the card identifier.

S202, sending a door opening request to a server, wherein the door opening request contains an identifier of the access card, an identifier of the first card reader, and an identifier of the first access controller.

When the access controller 01 detects that the card reader 02 has successfully read the identifier of the card, the access controller 01 sends a door opening request to the server connected to it. The door opening request contains the identifier Z of the access card, the identifier 02 of the first card reader that reads the access card, and the identifier 01 of the first access controller. The first card reader 02 is a card reader on the door controlled by the first access controller 01.

After receiving the door opening request sent by the access controller, the server searches, based on the identifier of the access card contained in the door opening request, for the identifier of the second card reader that read the access card last time, and the identifier of the second access controller corresponding to the second card reader. The sever determines a route for the door opening request, according to the identifier of the first card reader and the identifier of the first access controller, and the identifier of the second card reader and the identifier of the second access controller contained in the door opening request. The sever determines whether the determined route exists in a preset list of routes; and if so, sends the door opening instruction to the first access controller.

S203, receiving a door opening instruction from the server.

S204, controlling the door corresponding to the door opening request to open.

After receiving the door opening instruction sent by the server, the access controller 01 controls the door A to open.

In the embodiment shown in FIG. 2 of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for the identifier of the second card reader that read the access card last time, and the identifier of the second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include a route between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

In the embodiment illustrated herein, the access controller may be configured to enable or disenable the anti-passback function. It can be understood that the anti-passback function can be enabled or disabled depending on actual needs. After the access controller detects that the first card reader successfully reads the identifier of the access card, it may first determine whether the anti-passback function is enabled. If it is enabled, the access controller carries out the solution above; or otherwise, the access controller directly controls the door where the first card reader is located to open, without sending a door opening request to the server.

In accordance with the method embodiments described above, an embodiment of the present application further provides an anti-passback apparatus.

Figure 3:
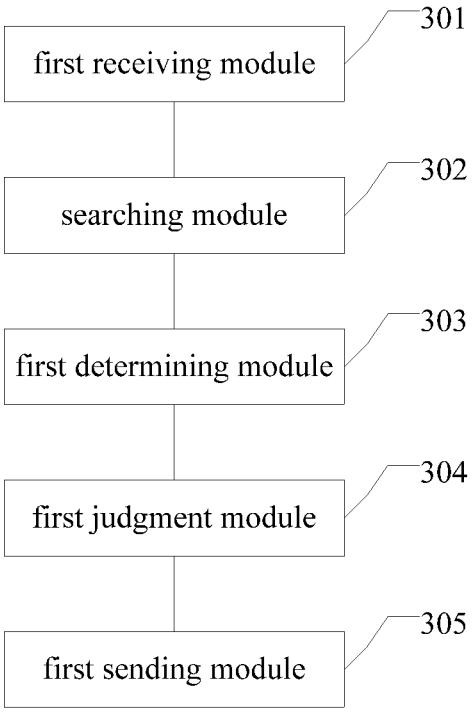
FIG. 3 is a schematic structural diagram of an anti-passback apparatus applied to a server provided by an embodiment of the present application.

FIG. 3 is a block diagram of an anti-passback apparatus provided by an embodiment of the present application, applicable to a server. The server is communicatively connected to at least two access controllers. The apparatus includes:

a first receiving module 301, configured for receiving a door opening request sent by a first access controller, wherein the door opening request contains an identifier of an access card, an identifier of the first access controller, and an identifier of a first card reader reading the access card this time, the first card reader being attached to a door controlled by the first access controller; a searching module 302, configured for searching, based on the identifier of the access card, for an identifier of a second card reader that read the access card last time, and an identifier of a second access controller corresponding to the second card reader; a first determining module 303, configured for determining a route for the door opening request according to the identifier of the first card reader, the identifier of the first access controller, the identifier of the second card reader, and the identifier of the second access controller; a first judging module 304, configured for determining whether the determined route exists in a preset list of routes; and a first sending module 305, configured for sending, when the judging module determines that the determined route exists in the preset list of routes, a door opening instruction to the first access controller to allow the first access controller to open a door corresponding to the door opening request according to the door opening instruction.

In the embodiment illustrated herein, the apparatus can further include:

an update module (not shown), configured for updating the identifier of the card reader that read the access card last time from the identifier of the second card reader to the identifier of the first card reader, and updating the identifier of the access controller corresponding to the card reader that read the access card last time from the identifier of the second access controller to the identifier of the first access controller.

In the embodiment illustrated herein, a first valid period for correspondence among an identifier of an access card, an identifier of a card reader and an identifier of an access controller is set in the server. The apparatus can further include:

a second judgment module (not shown), configured for determining, according to the first valid period, whether a correspondence among the identifier of the access card, the identifier of the first card reader, and the identifier of the first access controller is valid at the moment, and if so, triggering the searching module 302.

In the embodiment illustrated herein, the apparatus can further include:

a second sending module (not shown), configured for sending a door opening instruction to the first access controller directly, when the searching module 302 does not find the identifier of the second card reader and the identifier of the second access controller.

In the embodiment illustrated herein, an identifier of an initial card reader and a second valid period for correspondence between an identifier of an access card and the identifier of the initial card reader may be set in the server. The apparatus further includes: a third judgment module, a fourth judgment module, and a third sending module (not shown).

The third judgment module is configured for determining whether the first card reader is the initial card reader, and if not, triggering the searching module.

The fourth judgment module is configured for determining, according to the second valid period, whether a correspondence between the identifier of the access card and the identifier of the initial card reader is valid at the moment, when the third judgment module determines that the first card reader is the initial card reader.

The third sending module is configured for sending a door opening instruction to an access controller corresponding to the initial card reader, when the fourth determining module determines that the correspondence between the identifier of the access card and the identifier of the initial card reader is valid at the moment.

In the embodiment shown in FIG. 3 of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

Figure 4:
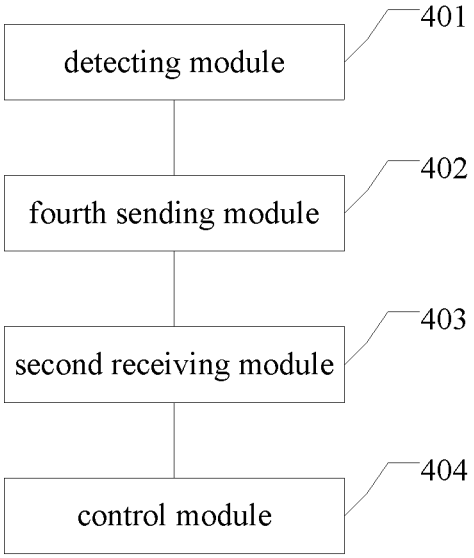
FIG. 4 is a schematic structural diagram of an anti-passback apparatus applied to a first access controller provided by an embodiment of the present application.

FIG. 4 is a block diagram of an anti-passback apparatus provided by an embodiment of the present application, applicable to a first access controller. The first access controller is communicatively connected to a server. The apparatus includes:

a detecting module 401, configured for detecting whether a first card reader attached to a door controlled by the first access controller successfully reads an identifier of an access card, and if so, triggering a fourth sending module;

a fourth sending module 402, configured for sending a door opening request to the server, wherein the door opening request contains the identifier of the access card, the identifier of the first card reader, and the identifier of the first access controller;

a second receiving module 403, configured for receiving a door opening instruction sent by the server, wherein the door opening instruction is sent by the server when a route determined according to an identifier of a second card reader, an identifier of a second access controller corresponding to the identifier of the second card reader, the identifier of the first card reader, and the identifier of the first access controller exists in a preset list of routes; the identifier of the second card reader is an identifier of a card reader that last read the access card, which is found according to the identifier of the access card; and the second card reader is a card reader attached to a door controlled by the second access controller; and a control module 404, configured for controlling a door corresponding to the door opening request to open.

In the embodiment illustrated herein, the apparatus can further include a fifth judgment module, configured for determining whether an anti-passback function is enabled, and if so, triggering the fourth sending module 402.

In the embodiment shown in FIG. 4 of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user presents an access card to a card reader on any of the doors, the access controller that controls the door where the card reader is located will transmit information to the server. The server determines whether to allow the passing based on the preset list of routes. As can be seen, such solution achieves the anti-passback feature among a plurality of access controllers.

FIG. 5 is a block diagram of an anti-passback system provided by an embodiment of the present application. The anti-passback system includes a server, at least two access controllers (access controller 1, access controller 2, . . . , and access controller N), and card readers (card reader 1, card reader 2, . . . , card reader P, card reader Q, . . . , card reader X, and card reader Y), as shown in FIG. 5. The server is in communication with the access controllers, and the card readers are placed on doors controlled by the access controllers.

The card reader is configured for reading an identifier of an access card, and uploading the identifier of the access card and its own identifier to an access controller.

The access controllers are configured for: detecting whether a first card reader attached to a door controlled by the first access controller successfully reads an identifier of an access card; if so, sending a door opening request to the server, wherein the door opening request contains the identifier of the access card, the identifier of the first card reader, and the identifier of the first access controller; receiving a door opening instruction sent by the server, wherein the door opening instruction is sent by the server when a route determined according to an identifier of a second card reader, an identifier of a second access controller, the identifier of the first card reader, and the identifier of the first access controller exists in a preset list of routes; the identifier of the second card reader is an identifier of a card reader read the access card last time, which is found according to the identifier of the access card; and the second card reader is a card reader attached to a door controlled by the second access controller; and controlling a door corresponding to the door opening request to open.

The server is configured for: receiving a door opening request sent by a first access controller, wherein the door opening request contains an identifier of an access card, the identifier of the first access controller, and an identifier of a first card reader reading the access card this time, the first card reader being attached to a door controlled by the first access controller; searching, based on the identifier of the access card, for an identifier of a second card reader that read the access card last time, and an identifier of a second access controller corresponding to the second card reader; determining a route for the door opening request according to the identifier of the first card reader, the identifier of the first access controller, the identifier of the second card reader, and the identifier of the second access controller; determining whether the determined route exists in a preset list of routes; and if so, sending a door opening instruction to the first access controller to allow the first access controller to open a door corresponding to the door opening request according to the door opening instruction.

In the embodiment illustrated herein, the server can further configured for, after sending the door opening instruction to the first access controller, updating the identifier of the card reader that read the access card last time from the identifier of the second card reader to the identifier of the first card reader, and updating the identifier of the access controller corresponding to the card reader that read the access card last time from the identifier of the second access controller to the identifier of the first access controller.

In the embodiment illustrated herein, a first valid period for correspondence among an identifier of an access card, an identifier of a card reader and an identifier of an access controller is set in the server.

The server can be further configured for determining, according to the first valid period, whether a correspondence among the identifier of the access card, the identifier of the first card reader, and the identifier of the first access controller is valid at the moment, after receiving the door opening request sent by the first access controller; and if so, performing the step of: searching, based on the identifier of the access card, for an identifier of a second card reader that read the access card last time, and an identifier of a second access controller corresponding to the second card reader.

In the embodiment illustrated herein, the server can further configured for sending a door opening instruction to the first access controller directly, when the identifier of the second card reader and the identifier of the second access controller are not found.

In the embodiment illustrated herein, an identifier of an initial card reader and a second valid period for correspondence between an identifier of an access card and the identifier of the initial card reader are set in the server.

The server can be further for determining whether the first card reader is the initial card reader; if the first card reader is not the initial card reader, performing the step of: searching, based on the identifier of the access card, for an identifier of a second card reader that read the access card last time, and an identifier of a second access controller corresponding to the second card reader; and if the first card reader is the initial card reader, determining, according to the second valid period, whether a correspondence between the identifier of the access card and the identifier of the initial card reader is valid at the moment; and if the correspondence is valid, sending a door opening instruction to an access controller corresponding to the initial card reader.

In the embodiment illustrated herein, the access controllers can be further configured for determining whether to enable an anti-passback function, after detecting that the first card reader has successfully read the identifier of the access card; and if so, performing the step of sending a door opening request to the server.

In the embodiment shown in FIG. 5 of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

Figure 6:
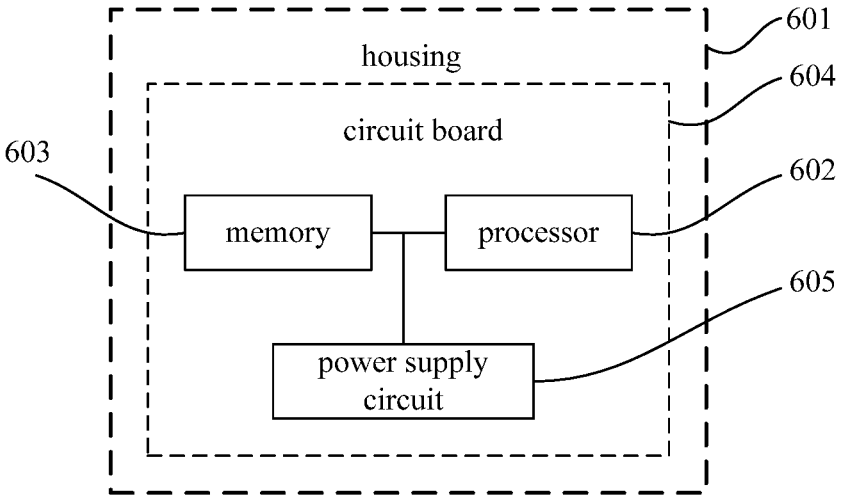
FIG. 6 is a schematic structural diagram of a server provided by an embodiment of the present application.

An embodiment of the present application further provides a server, as shown in FIG. 6. The server includes a housing 601, a processor 602, a memory 603, a circuit board 604 and a power supply circuit 605. The circuit board 604 is arranged inside a space enclosed by the housing 601. The processor 602 and the memory 603 are arranged on the circuit board 604. The power supply circuit 605 is used to supply power for various circuits or components of the server. The memory 603 is used to store an executable program code. The processor 602 is configured for executing a program corresponding to the executable program code by reading the executable program code stored in the memory to perform the anti-passback method. The method includes:

receiving a door opening request sent by a first access controller, wherein the door opening request contains an identifier of an access card, an identifier of the first access controller, and an identifier of a first card reader reading the access card this time, the first card reader being attached to a door controlled by the first access controller;

searching, based on the identifier of the access card, for an identifier of a second card reader that read the access card last time, and an identifier of a second access controller corresponding to the second card reader;

determining a route for the door opening request according to the identifier of the first card reader, the identifier of the first access controller, the identifier of the second card reader, and the identifier of the second access controller;

determining whether the determined route exists in a preset list of routes; and if so, sending a door opening instruction to the first access controller to allow the first access controller to open a door corresponding to the door opening request according to the door opening instruction.

In the embodiment shown in FIG. 6 of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

An embodiment of the present application further provides an executable program code configured for performing, when being executed, the anti-passback method. The method includes:

receiving a door opening request sent by a first access controller, wherein the door opening request contains an identifier of an access card, an identifier of the first access controller, and an identifier of a first card reader reading the access card this time, the first card reader being attached to a door controlled by the first access controller;

searching, based on the identifier of the access card, for an identifier of a second card reader that read the access card last time, and an identifier of a second access controller corresponding to the second card reader;

determining a route for the door opening request according to the identifier of the first card reader, the identifier of the first access controller, the identifier of the second card reader, and the identifier of the second access controller;

determining whether the determined route exists in a preset list of routes; and if so, sending a door opening instruction to the first access controller to allow the first access controller to open a door corresponding to the door opening request according to the door opening instruction.

In the embodiment of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

An embodiment of the present application further provides a storage medium. The storage medium is configured for storing an executable program code which, when being executed, perform the anti-passback method. The method includes:

receiving a door opening request sent by a first access controller, wherein the door opening request contains an identifier of an access card, an identifier of the first access controller, and an identifier of a first card reader reading the access card this time, the first card reader being attached to a door controlled by the first access controller;

searching, based on the identifier of the access card, for an identifier of a second card reader that read the access card last time, and an identifier of a second access controller corresponding to the second card reader;

determining a route for the door opening request according to the identifier of the first card reader, the identifier of the first access controller, the identifier of the second card reader, and the identifier of the second access controller;

determining whether the determined route exists in a preset list of routes; and if so, sending a door opening instruction to the first access controller to allow the first access controller to open a door corresponding to the door opening request according to the door opening instruction.

In the embodiment of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

Figure 7:
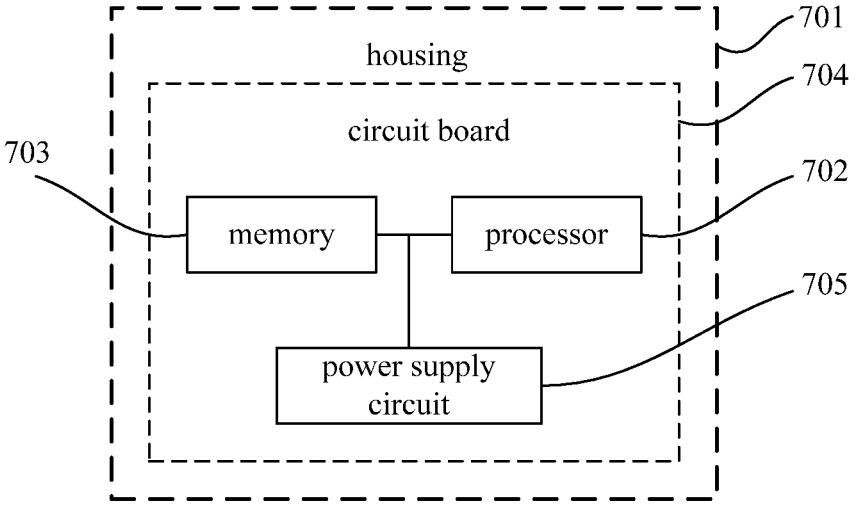
FIG. 7 is a schematic structural diagram of an access controller provided by an embodiment of the present application.

An embodiment of the present application further provides an access controller, as shown in FIG. 7. The access controller includes: a housing 701, a processor 702, a memory 703, a circuit board 704 and a power supply circuit 705. The circuit board 704 is arranged inside a space enclosed by the housing 701. The processor 702 and the memory 703 are arranged on the circuit board 704. The power supply circuit 705 is used to supply power for various circuits or components of the access controller. The memory 703 is used to store an executable program code. The processor 702 is configured for executing the program instructions stored in the memory 703 to perform the anti-passback method. The method includes:

detecting whether a first card reader attached to a door controlled by the first access controller successfully reads an identifier of an access card;

if so, sending a door opening request to the server, wherein the door opening request contains an identifier of the access card, an identifier of the first card reader, and an identifier of the first access controller;

receiving a door opening instruction sent by the server, wherein the door opening instruction is sent by the server when a route determined according to an identifier of a second card reader, an identifier of a second access controller, the identifier of the first card reader, and the identifier of the first access controller exists in a preset list of routes, the identifier of the second card reader is an identifier of a card reader that is found, according to the identifier of the access card, to last read the access card; and the second card reader is a card reader attached to a door controlled by the second access controller; and controlling a door corresponding to the door opening request to open.

In the embodiment shown in FIG. 7 of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

An embodiment of the present application further provides an executable program code configured for performing, when being executed, the anti-passback method. The method includes:

detecting whether a first card reader attached to a door controlled by the first access controller successfully reads an identifier of an access card;

if so, sending a door opening request to the server, wherein the door opening request contains an identifier of the access card, an identifier of the first card reader, and an identifier of the first access controller;

receiving a door opening instruction from the server, wherein the door opening instruction is sent by the server when a route determined according to an identifier of a second card reader, an identifier of a second access controller, the identifier of the first card reader, and the identifier of the first access controller exists in a preset list of routes; the identifier of the second card reader is an identifier of a card reader that read the access card last time, which is found according to the identifier of the access card; and the second card reader is a card reader attached to a door controlled by the second access controller; and controlling a door corresponding to the door opening request to open.

In the embodiment of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

An embodiment of the present application further provides a storage medium. The storage medium is configured for storing an executable program code which, when being executed, perform the anti-passback method. The method includes:

detecting whether a first card reader attached to a door controlled by the first access controller successfully reads an identifier of an access card;

if so, sending a door opening request to the server, wherein the door opening request contains an identifier of the access card, an identifier of the first card reader, and an identifier of the first access controller;

receiving a door opening instruction from the server, wherein the door opening instruction is sent by the server when a route determined according to an identifier of a second card reader, an identifier of a second access controller, the identifier of the first card reader, and the identifier of the first access controller exists in a preset list of routes; the identifier of the second card reader is an identifier of a card reader that is found, according to the identifier of the access card, to last read the access card; and the second card reader is a card reader attached to a door controlled by the second access controller; and controlling a door corresponding to the door opening request to open.

In the embodiment of the present application, a plurality of access controllers are communicatively connected to the server. After detecting that the first card reader has successfully read the identifier of the access card, the first access controller sends the identifier of the access card, the identifier of the first card reader, and its own identifier to the server. The server searches, based on the identifier of the access card, for an identifier of a second card reader that read the access card last time, and an identifier of a second access controller corresponding to the second card reader. The sever determines the route for the door opening request, according to the identifier of the second card reader, the identifier of the second access controller, the identifier of the first card reader, and the identifier of the first access controller. The sever determines whether the determined route exists in a preset list of routes, and if so, sends the door opening instruction to the first access controller, such that the first access controller controls a door corresponding to the door opening request to open according to the door opening instruction. The preset list of routes may include routes between doors under control of the plurality of access controllers communicatively connected to the server. When a user swipes a card reader on any of the doors with an access card, the access controller that controls the door where the card reader is located will transmit information to the server. The server determines whether to allow the passing based on the route list. As can be seen, such a solution achieves an anti-passback feature in the case of a plurality of access controllers.

It should be noted that the relationship terms herein such as "first", "second" and the like are only configured for distinguishing one entity or operation from another entity or operation, but do not necessarily require or imply that there is any actual relationship or order between these entities or operations. Moreover, the terms "include", "comprise" or any other variants thereof are intended to cover non-exclusive inclusions, so that processes, methods, articles or apparatuses comprising a series of elements comprise not only those elements listed but also those not specifically listed or the elements intrinsic to these processes, methods, articles, or apparatuses. Without further limitations, elements defined by the sentences "comprise(s) a" or "include(s) a" do not exclude that there are other identical elements in the processes, methods, articles, or apparatuses which include these elements.

All the embodiments are described in corresponding ways, same or similar parts in each of the embodiments can be referred to one another, and the parts emphasized are differences to other embodiments. Particularly, the embodiments of the apparatus are described briefly, since they are similar to the embodiments of the method, and for similar parts, one could refer to the corresponding description of the embodiments of the method.

It will be understood by those of ordinary skills in the art that all or some of the steps in the methods described above may be accomplished by a program to instruct the associated hardware. The program may be stored in a computer-readable storage medium, such as ROMs/RAMs, magnetic disks, optical disks, or the like.

The embodiments described above are merely preferred embodiments of the present application, and not intended to limit the scope of the present application. Any modifications, equivalents, improvements or the like within the spirit and principle of the application should be included in the scope of the application.

The invention claimed is:

1. An anti-passback method, applicable to a server communicatively connected to at least two access controllers, comprising:

receiving a door opening request sent by a first access controller, wherein the door opening request contains an identifier of an access card, an identifier of the first access controller, and an identifier of a first card reader reading the access card this time, the first card reader being attached to a door controlled by the first access controller;

searching, based on the identifier of the access card, for an identifier of a second card reader that read the access card last time, and an identifier of a second access controller corresponding to the second card reader;

determining a route for the door opening request, wherein, the route is represented by the identifier of the first card reader, the identifier of the first access controller, the identifier of the second card reader, and the identifier of the second access controller;

determining whether the determined route exists in a preset list of routes preconfigured in the server; and if so, sending a door opening instruction to the first access controller to allow the first access controller to open a door corresponding to the door opening request according to the door opening instruction, wherein after sending the door opening instruction to the first access controller, the method further comprises:

updating the identifier of the card reader that read the access card last time from the identifier of the second card reader to the identifier of the first card reader, and updating the identifier of the access controller corresponding to the card reader that read the access card last time from the identifier of the second access controller to the identifier of the first access controller.

2. The method of claim 1, wherein a first valid period for correspondence among an identifier of an access card, an identifier of a card reader and an identifier of an access controller is set in the server, and after receiving the door opening request sent by the first access controller, the method further comprises:

determining, according to the first valid period, whether a correspondence among the identifier of the access card, the identifier of the first card reader, and the identifier of the first access controller is valid at the moment;

if so, performing the step of: searching, based on the identifier of the access card, for an identifier of a second card reader that read the access card last time, and an identifier of a second access controller corresponding to the second card reader.

3. The method of claim 2, further comprising:

sending a door opening instruction to the first access controller directly in the case that the identifier of the second card reader and the identifier of the second access controller are not found.

4. The method of claim 1, wherein an identifier of an initial card reader and a second valid period for correspondence between an identifier of an access card and the identifier of the initial card reader are set in the server, and after receiving the door opening request sent by the first access controller, the method further comprises:

determining whether the first card reader is the initial card reader;

if the first card reader is not the initial card reader, performing the step of: searching, based on the identifier of the access card, for an identifier of a second card reader that read the access card last time, and an identifier of a second access controller corresponding to the second card reader; and if the first card reader is the initial card reader, determining, according to the second valid period, whether the correspondence between the identifier of the access card and the identifier of the initial card reader is valid at the moment; and if the correspondence is valid, sending a door opening instruction to an access controller corresponding to the initial card reader.

5. A server, comprising a housing, a processor, a memory, a circuit board and a power supply circuit, wherein the circuit board is arranged inside a space enclosed by the housing, the processor and the memory are arranged on the circuit board; the power supply circuit is used to supply power for various circuits or components of the server; the memory is used to store an executable program code; and the processor is configured for executing a program corresponding to the executable program code by reading the executable program code stored in the memory to perform the anti-passback method of claim 1.

6. A non-transitory storage medium configured for storing an executable program code which, when being executed, perform the anti-passback method of claim 1.

7. An anti-passback method, applicable to a first access controller communicatively connected to a server, comprising:

detecting whether a first card reader attached to a door controlled by the first access controller successfully reads an identifier of an access card;

if so, sending a door opening request to the server, wherein the door opening request contains an identifier of the access card, an identifier of the first card reader, and an identifier of the first access controller;

receiving a door opening instruction sent by the server, wherein the door opening instruction is sent by the server when a route represented by an identifier of a second card reader, an identifier of a second access controller, the identifier of the first card reader, and the identifier of the first access controller exists in a preset list of routes preconfigured in the server; the identifier of the second card reader is an identifier of a card reader that reads the access card last time, which is found according to the identifier of the access card; and the second card reader is a card reader attached to a door controlled by the second access controller; and controlling a door corresponding to the door opening request to open, wherein after sending the door opening instruction to the first access controller, the server updates the identifier of the card reader that read the access card last time from the identifier of the second card reader to the identifier of the first card reader, and updates the identifier of the access controller corresponding to the card reader that read the access card last time from the identifier of the second access controller to the identifier of the first access controller.

8. The method of claim 7, wherein after detecting that the first card reader successfully reads the identifier of the access card, the method further comprises:

determining whether an anti-passback function is enabled; and if so, performing the step of sending a door opening request to the server.

9. An access controller, comprising a housing, a processor, a memory, a circuit board and a power supply circuit, wherein the circuit board is arranged inside a space enclosed by the housing, the processor and the memory are arranged on the circuit board; the power supply circuit is used to supply power for various circuits or components of the access controller; the memory is used to store an executable program code; and the processor is configured for executing a program corresponding to the executable program code by reading the executable program code stored in the memory to perform the anti-passback method of claim 7.

10. A non-transitory storage medium, configured for storing an executable program code which, when being executed, perform the anti-passback method of claim 7.

11. An anti-passback system, comprising a server, at least two access controllers, and a card reader, wherein the card reader is configured for reading an identifier of an access card, and uploading the identifier of the access card and its own identifier to the access controllers;

the access controllers are configured for: detecting whether a first card reader attached to a door controlled by a first access controller successfully reads an identifier of an access card; if so, sending a door opening request to the server, wherein the door opening request contains the identifier of the access card, an identifier of the first card reader, and an identifier of the first access controller; receiving a door opening instruction sent by the server, wherein the door opening instruction is sent by the server when a route represented by an identifier of a second card reader, an identifier of a second access controller, the identifier of the first card reader, and the identifier of the first access controller exists in a preset list of routes preconfigured in the server; the identifier of the second card reader is an identifier of a card reader that read the access card last time, which is found according to the identifier of the access card; and the second card reader is a card reader attached to a door controlled by the second access controller; and controlling a door corresponding to the door opening request to open;

the server is configured for: receiving a door opening request sent by a first access controller, wherein the door opening request contains an identifier of an access card, the identifier of the first access controller, and an identifier of a first card reader reading the access card this time, the first card reader being attached to a door controlled by the first access controller; searching, based on the identifier of the access card, for an identifier of a second card reader that read the access card last time, and an identifier of a second access controller corresponding to the second card reader; determining a route for the door opening request, wherein, the route is represented by the identifier of the first card reader, the identifier of the first access controller, the identifier of the second card reader, and the identifier of the second access controller; determining whether the determined route exists in a preset list of routes preconfigured in the server; and if so, sending a door opening instruction to the first access controller to allow the first access controller to open a door corresponding to the door opening request according to the door opening instruction, wherein after sending the door opening instruction to the first access controller, the server is configured to: update the identifier of the card reader that read the access card last time from the identifier of the second card reader to the identifier of the first card reader, and update the identifier of the access controller corresponding to the card reader that read the access card last time from the identifier of the second access controller to the identifier of the first access controller.

* * * * *